United States Patent [19]

Pedersen

[11] 4,037,743

[45] July 26, 1977

[54] MATERIAL HANDLING BUCKET DUAL CYLINDER SYSTEM

[75] Inventor: Carl Oluf Pedersen, Burlington, Iowa

[73] Assignee: J. I. Case Company, Racine, Wis.

[21] Appl. No.: 648,881

[22] Filed: Jan. 14, 1976

[51] Int. Cl.[2] ..... E02F 3/70

[52] U.S. Cl. ..... 214/140; 91/413

[58] Field of Search ..... 214/140, 762; 91/411 Q, 91/413

[56] References Cited

U.S. PATENT DOCUMENTS

| | | | |
|---|---|---|---|
| 2,935,852 | 5/1960 | Russell | 214/140 |
| 3,105,603 | 10/1963 | Beyerstedt et al. | 214/762 |
| 3,490,340 | 1/1970 | Pedersen | 91/413 |
| 3,705,631 | 12/1972 | Seaberg | 91/413 |

*Primary Examiner*—Albert J. Makay
*Assistant Examiner*—Ross Weaver
*Attorney, Agent, or Firm*—Arthur J. Hansmann

[57] ABSTRACT

A material handling bucket dual cylinder system having two fluid valves and two fluid cylinder assemblies comprising a fluid system which controls the loading and dumping of a bucket. The system is arranged so that all of the fluid power can be directed for forceful action, such as loading the bucket, and the fluid power can also be utilized for a fast bucket action, such as dumping the bucket.

4 Claims, 4 Drawing Figures

MATERIAL HANDLING BUCKET DUAL CYLINDER SYSTEM

This invention relates to a material handling bucket dual cylinder system, and it is particularly useful in a backhoe bucket arrangement and is useful in directing all of the fluid power to the bucket, such as is desired when loading the bucket, and the fluid power can also be directed for dumping the bucket in a very fast action.

BACKGROUND OF THE INVENTION

The prior art is already aware of arrangements of material handling buckets which are under the control of fluid actuated apparatus, such as hydraulic cylinders. One isolated example of the arrangement in a backhoe is found in U.S. Pat. No. 3,220,579. It is the common practice in the prior art to have only one cylinder assembly for actuating a material handling bucket. Thus it is inherent in that arrangement that the bucket is moved with a certain force and at a certain speed, both consequences being determined by the capabilities of the fluid system and of the one cylinder itself.

The present invention utilizes two fluid cylinders for actuating the bucket, and the use of two cylinders is more efficient and less expensive than the use of a single cylinder assembly. Further, the arrangement of two cylinder assemblies in the present invention permits a forceful action on the bucket and it also permits a fast action on the bucket. That is, both cylinders can be pressurized when a forceful action is desired, such as when loading the bucket, and only one of the two cylinders can be pressurized, when a fast action is desired such as for emptying the bucket. Accordingly, the present invention provides a material handling bucket dual cylinder system which permits and utilizes the full fluid power available for maximum forceful actions when desired, and it also permits and utilizes a fast fluid power action when that is desired such as in the dumping or cleaning or like maneuvering of the bucket. Further, the present invention accomplishes the aforementioned objectives with a minimum of apparatus and without complex valves and complex apparatus, and the apparatus is therefore efficient and reliable and easy to operate so that the desired forceful or fast maneuverings can be accomplished.

Other objects and advantages will become apparent upon reading the following description in light of the accompanying drawings.

DETAILED DESCRIPTION OF THE PREFERRED EMBODIMENT

Figure 1:
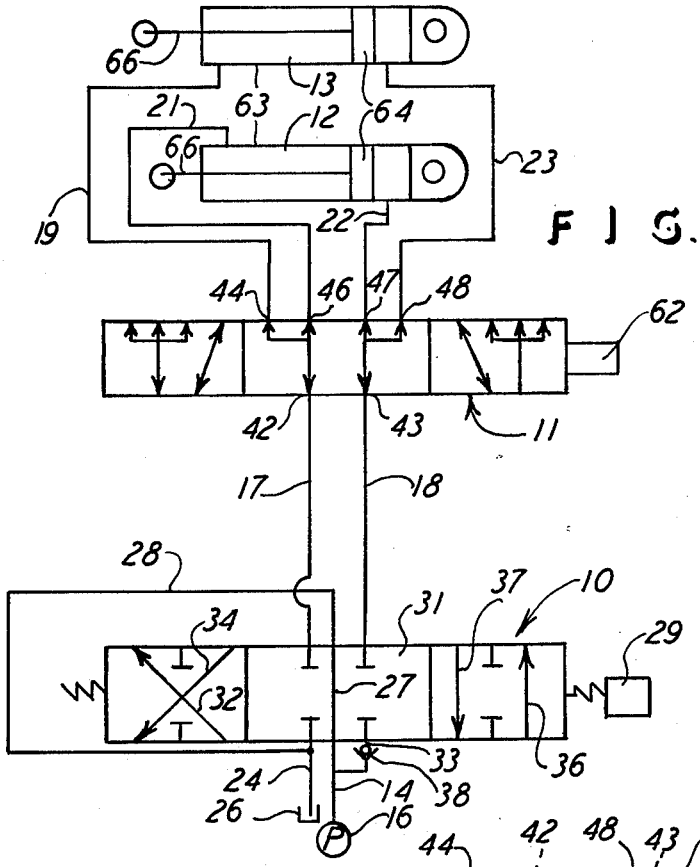
FIG. 1 is a schematic view of the dual cylinder system of this invention.

FIG. 1 schematically shows the apparatus of this invention, and that includes a first fluid valve 10 and a second fluid valve 11 and two fluid cylinder assemblies 12 and 13 and it includes fluid connecting lines shown, such as the line 14 connected between a fluid pump 16 and the valve 10, and the lines 17 and 18 connecting between the valves 10 and 11, and the lines 19, 21, 22, and 23 connecting between the valve 11 and the cylinder assemblies 12 and 13. The system also includes a return fluid line 24 which extends to a reservoir 26. As shown in FIG. 1, one skilled in the art will readily understand that the fluid system is arranged to have the pump 16 supply fluid underpressure to the valves 10 and 11 and then to the cylinders 12 and 13, all depending upon the positioning of the valves 10 and 11, as explained hereinafter. Also, one skilled in the art will readily appreciate and understand that the cylinders 12 and 13 are connectable to a material handling bucket for the purpose of actuating the bucket to load and to dump the bucket, and the general arrangement of a hydraulic or fluid cylinder connected to a bucket is shown in U.S. Pat. No. 3,220,579, for instance.

The first valve 10 is shown to be of an open-center type having the passageway 27 which permits the flow of fluid from the pump 16 and to the line 28 and back to the tank or reservoir 26. Also, the valve 10 is shown to be of a spool type, as is the valve 11, and the valve 10 is thus shiftable to where its other passageways can align with the lines 17 and 18 to thereby pass fluid underpressure to the valve 11. A manual type of control 29 is schematically indicated in operative association with the valve 10 for the shifting of the valve spool designated 31. Accordingly, shifting the spool 31 to the right, as viewed in FIG. 1, will permit the spool passageway 32 to fluid-flow connect between the fluid line 33 and the fluid line 17 to thereby direct the fluid underpressure from the pump 16 and to the line 17 and up to the valve 11. Likewise, the spool passageway 34 will fluid-flow connect between the line 18 and the line 24 to direct the return from the valve 11 and back to the tank 26, all as indicated by the conventional showing of the valve 10 and as will be understood by one skilled in the art. Similarly, shifting the valve spool 31 to the left, as viewed in FIG. 1, will cause the valve fluid passageway 36 to fluid-flow connect between the line 33 and the line 18, to pass fluid to the valve 11 in that direction of flow, and, similarly, the valve fluid passageway 37 would then be connected between the line 17 and the line 24 for the return flow from the valve 11 and to the tank 26.

Accordingly, the valve 10 passes fluid to the lines 17 and 18 in both directions of flow in each of the lines, for the desired forward or reverse type of fluid pressurizing of the valve 11. Also, a conventional type of fluid-flow check valve 38 is shown in the line 33 such that when the line 33 is under backflow type of pressure from the line 18, the valve 38 will hold the pressure in the line 18, as desired and as will be apparent and is effective on the cylinder assemblies 12 and 13.

Figure 2:
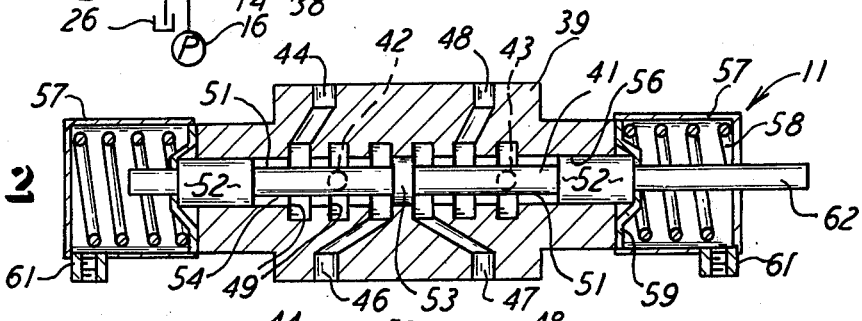
FIGS. 2, 3, and 4 are sectional views of one of the valves shown in FIG. 1, and with the valve in different positions in the three views.

The second valve 11 has a valve body 39 and a shiftable spool 41, and it also has two fluid ports designated 42 and 43 fluid-flow connected with the valve 10 through the lines 17 and 18, and it has four fluid ports 44, 46, 47, and 48, fluid-flow connected with the cylinder assemblies 12 and 13 through the lines 19, 21, 22, and 23, respectively. FIG. 2 shows the location of the six ports mentioned, and it will be seen that the ports 42 and 43 are shown on the far side of the valve body 39, as viewed in FIG. 2, and the ports 44 through 48 are as shown also.

The valve 11 also has a plurality of fluid passageways 49, and these are shown to be concentric passageways within the housing 39 and spaced therealong and are actually shown to be six in number, and each of the passageways 49 is directly fluid-flow connected with one of the six ports described. Further, the spool 41 has a recessed portion 51 on each end thereof, and the spool 41 thus has a fluid passageway defined by the portion 51 extending between the spool enlarged ends 52 and the enlarged fluid sealing central portion 53 of the spool 41, and the spool therefore presents fluid passageways designated 54 on each opposite end of the spool 41.

Thus, it will be seen that the housing 39 has a central bore 56 which slidably receives the spool 41, and the spool has its opposite ends projecting into enclosures 57 suitably affixed to the housing 39. A compression spring 58 is in each enclosure 57, and a plate 59 abuts the inner end of each spring 58 and bears against the spool portion 52 to thus urge the spool 41 to a centered position, as shown in FIG. 2. Also, fluid connectors or nipples 61 are attached to the enclosures 57 to permit the introduction of fluid into the enclosures 57 and thereby force upon the plates 59 and thus position the spool 41, either by pressure or by a reduction of pressure, and the spool can also be manually or solenoid controlled, in any conventional manner, and the spool end 62 is shown extending outwardly of the enclosure 57 in FIG. 2, for the manual or solenoid control, as desired.

FIG. 2 shows the spool 41 in the neutral position in that the spool fluid sealing enlarged circular portion 53 is central between the passageways and ports heretofore described. Also, in the FIG. 2 position, it will be seen and understood that fluid under pressure could be entering the valve 11 through either port 42 or 43, depending upon the setting of the spool 31 of valve 10, and thus the fluid would be directed through the valve 11 and to the ports 44 and 46, or the ports 47 and 48, and therefore the similar ends of the cylinder assemblies 12 and 13 would be pressurized. By similar ends is meant either the head end or the rod end of the assemblies 12 and 13. Of course assemblies 12 and 13 include cylinders 63 and pistons 64 and rods 66. Therefore, if pressure were in the line 17 and directed to the port 42 and thus to the ports 44 and 46 and to the lines 19 and 21, then the rod ends of the assemblies 12 and 13 would be pressurized and that would give a maximum force to the system since both assemblies 12 and 13 would be under fluid pressure. Therefore, depending upon which of the two similar ends of the two assemblies 12 and 13 are pressurized, and of course depending upon the connection of the assemblies 12 and 13 with a material handling bucket, such as a backhoe bucket, the maximum force can be applied to the bucket for a loading of the bucket, for instance. Accordingly, where the assemblies 12 and 13 are connected with a backhoe bucket in an arrangement such that extension of the assemblies 12 and 13 will effect the loading action, then of course the pressurizing of the head ends of the assemblies 12 and 13 would be desired, and that of course would mean that the valve 11 would be in the position of FIG. 2 but with the pressure of the fluid extending into the lines 22 and 23.

Figure 3:
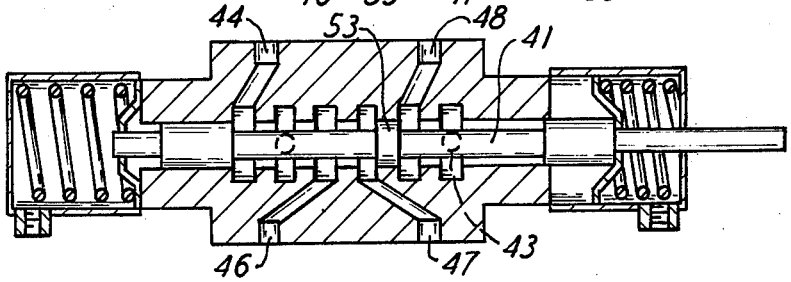

FIG. 3 shows a shifted position of the spool 41, and here it will be seen that the valve spool 31 could be set so that there would be fluid pressure at the port 43 and thus the port 48 would be under pressure and therefore the fluid pressure would be in the line 23 and thus only the head end of the cylinder assembly 13 would be pressurized. That condition could be utilized for a fast curl action of the backhoe bucket, since only one of the assemblies 12 and 13 is then subjected to fluid pressure, and that would create the lesser force but faster action, both of which would be desired.

Figure 4:
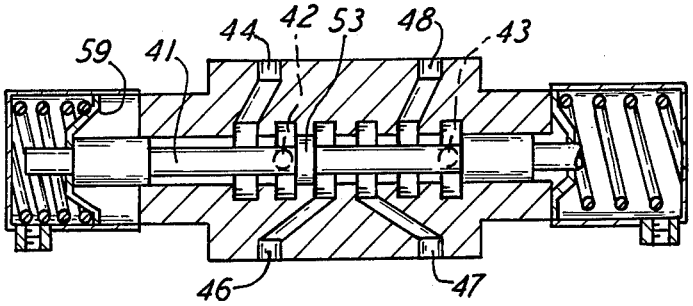

Finally, FIG. 4 shows a shifted position of the spool 41, and that position could be utilized for introducing pressure into the port 42 and to the port 44 and to the line 19 and thus to only the rod end of the assembly 13. That condition could be achieved for the function of a fast dumping action of the backhoe bucket where the dumping action is achieved by a contraction of the cylinder assembly 13. Of course in both of the settings of the spool 41 in FIGS. 3 and 4, the opposite one of the ports 42 and 43 is serving as the return port for the return flow through its respective line 17 or 18.

With this arrangement, the valve 10 serves as a reversing type valve relative to the speed control valve 11 which in turn has fluid passageways fluid-flow connected with similar ends of the cylinder assemblies 12 and 13. Further, the valve 11 has the plurality of passageways described, and it has the six ports described, and the spool 41 and the entire valve 11 is arranged so that various combinations of the lines 44, 46, 47, and 48 can be interconnected, such that the three lines 44, 46, and 47 are interconnected in the FIG. 3 position, for achieving the fast curl mode described, for instance. As such, there are three combinations of four fluid passageways in the valve 11.

What is claimed is:

1. A material handling bucket dual cylinder system comprising two fluid cylinders connectable to a bucket for loading and dumping actuations of the bucket, fluid actuated apparatus connected to said cylinders for powering said cylinders in the loading and dumping actuations, said apparatus including a first fluid valve and a second fluid valve with said valves being fluid-flow connected together in series, said first fluid valve having fluid passageways selectively interconnectable with said second fluid valve for passing fluid to said second fluid valve in two directions of fluid flow, said second fluid valve and said two cylinders having four fluid-flow separated fluid-flow lines connected therebetween for directing the flow of fluid to and from said cylinders for extension and contraction of said cylinders for use in the loading and the dumping of the bucket, said two cylinders having head and rod ends and said four fluid-flow lines being respectively and separately and exclusively directly connected to said cylinder ends, and said second fluid valve having three combinations of four fluid passageways in each of said three combinations and being arranged to selectively and separately fluid-flow connect each of said three combinations with said four fluid-flow lines for both simultaneous and individual selective fluid pressurizing of said two cylinder ends.

2. The material handling bucket dual cylinder system as claimed in claim 1, wherein at least some of said three combinations of said second fluid valve fluid passageways are arranged in groups to selectively fluid-flow interconnect with only one of said fluid passageways of said first valve for fluid-flow interconnecting as many as three of said fluid-flow lines with a selected one of the said fluid passageways of said first valve.

3. The material handling bucket dual cylinder system as claimed in claim 2, wherein said second fluid valve is of a spool type having six fluid ports being fluid-flow selectively connectable with each of said three combinations of four fluid passageways, two of said six fluid ports being fluid-flow connected with said first fluid valve and the other four thereof fluid-flow connected with said fluid-flow lines, and three of said fluid passageways in two of said three combinations being fluid-flow interconnected together for effecting identical fluid pressure at the respective three ends of said two cylinders.

4. The material handling bucket dual cylinder system as claimed in claim 3, wherein said first fluid valve is of a spool type arranged with its said fluid passageways shiftable for reversing the flow of fluid through said first fluid valve, and thereby doubling the variations possible in fluid pressurizing said cylinder ends.

* * * * *